US011366414B2

(12) United States Patent
Ito et al.

(10) Patent No.: US 11,366,414 B2
(45) Date of Patent: Jun. 21, 2022

(54) IMAGING APPARATUS WITH SELECTIVELY OPERATED IONIZER

(71) Applicant: Hewlett-Packard Development Company, L.P., Spring, TX (US)

(72) Inventors: Takuya Ito, Yokohama (JP); Takashi Nakazawa, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/416,651

(22) PCT Filed: Jun. 30, 2020

(86) PCT No.: PCT/US2020/040260
§ 371 (c)(1),
(2) Date: Jun. 21, 2021

(87) PCT Pub. No.: WO2021/003136
PCT Pub. Date: Jan. 7, 2021

(65) Prior Publication Data

US 2022/0137540 A1 May 5, 2022

(30) Foreign Application Priority Data

Jul. 1, 2019 (JP) ..... JP2019-122980

(51) Int. Cl.
*G03G 15/00* (2006.01)
*G03G 15/20* (2006.01)

(52) U.S. Cl.
CPC ..... *G03G 15/2039* (2013.01)

(58) Field of Classification Search
CPC ..... G03G 15/2039; G03G 21/206
USPC ..... 399/69, 93, 98
See application file for complete search history.

(56) References Cited

U.S. PATENT DOCUMENTS

| | | | | |
|---|---|---|---|---|
| 4,992,805 | A | 2/1991 | Yoshizawa et al. | |
| 10,241,463 | B2 | 3/2019 | Yabuki et al. | |
| 11,131,963 | B2 * | 9/2021 | Ono et al. | G03G 15/2039 |
| 11,221,587 | B2 * | 1/2022 | Ono et al. | G03G 21/206 |
| 2019/0049880 | A1 | 2/2019 | Hagiwara et al. | |
| 2019/0278222 | A1 * | 9/2019 | Ishikawa | G03G 21/206 |
| 2021/0063962 | A1 * | 3/2021 | Nakazawa et al. | G03G 21/206 |

FOREIGN PATENT DOCUMENTS

| | | | |
|---|---|---|---|
| DE | 19704003 | A1 | 8/1998 |
| EP | 2574463 | A1 | 4/2013 |
| JP | 20050055515 | | 3/2005 |
| JP | 20150141392 | | 8/2015 |
| JP | 20160014821 | | 1/2016 |
| JP | 20170023959 | | 2/2017 |
| WO | WO-2010086205 | A1 | 8/2010 |
| WO | WO-2021183237 | A1 * | 9/2021 |

* cited by examiner

*Primary Examiner* — William J Royer
(74) *Attorney, Agent, or Firm* — HP Inc. Patent Department

(57) ABSTRACT

An imaging system includes a fixing device, a collection device, and a controller. The collection device collects ultrafine particles (UFP) emitted by the fixing device. The collection device includes an ionizer. The controller turn on the ionizer.

15 Claims, 13 Drawing Sheets

IMAGING APPARATUS WITH SELECTIVELY OPERATED IONIZER

BACKGROUND

An image forming system may include a conveying device which conveys a printing medium, an image carrier which forms an electrostatic latent image thereon, a developing device which develops the electrostatic latent image, a transfer device which transfers a toner image onto the printing medium, a fixing device which fixes the toner image to the printing medium, and a discharge device which discharges the printing medium.

BRIEF DESCRIPTION OF DRAWINGS

FIG. 5 is a graph showing an example relationship between a UFP emission amount and the number of printed sheets when an ionizer is turned on.

DETAILED DESCRIPTION

In the following description, with reference to the drawings, the same reference numbers are assigned to the same components or to similar components having the same function, and overlapping description is omitted.

An imaging system (or image forming system) may include an image forming apparatus such as a printer in some examples, or a component or device forming part of the image forming apparatus in other examples. For example, the imaging system may be a developing device or the like used as a part of a printer.

Figure 1:
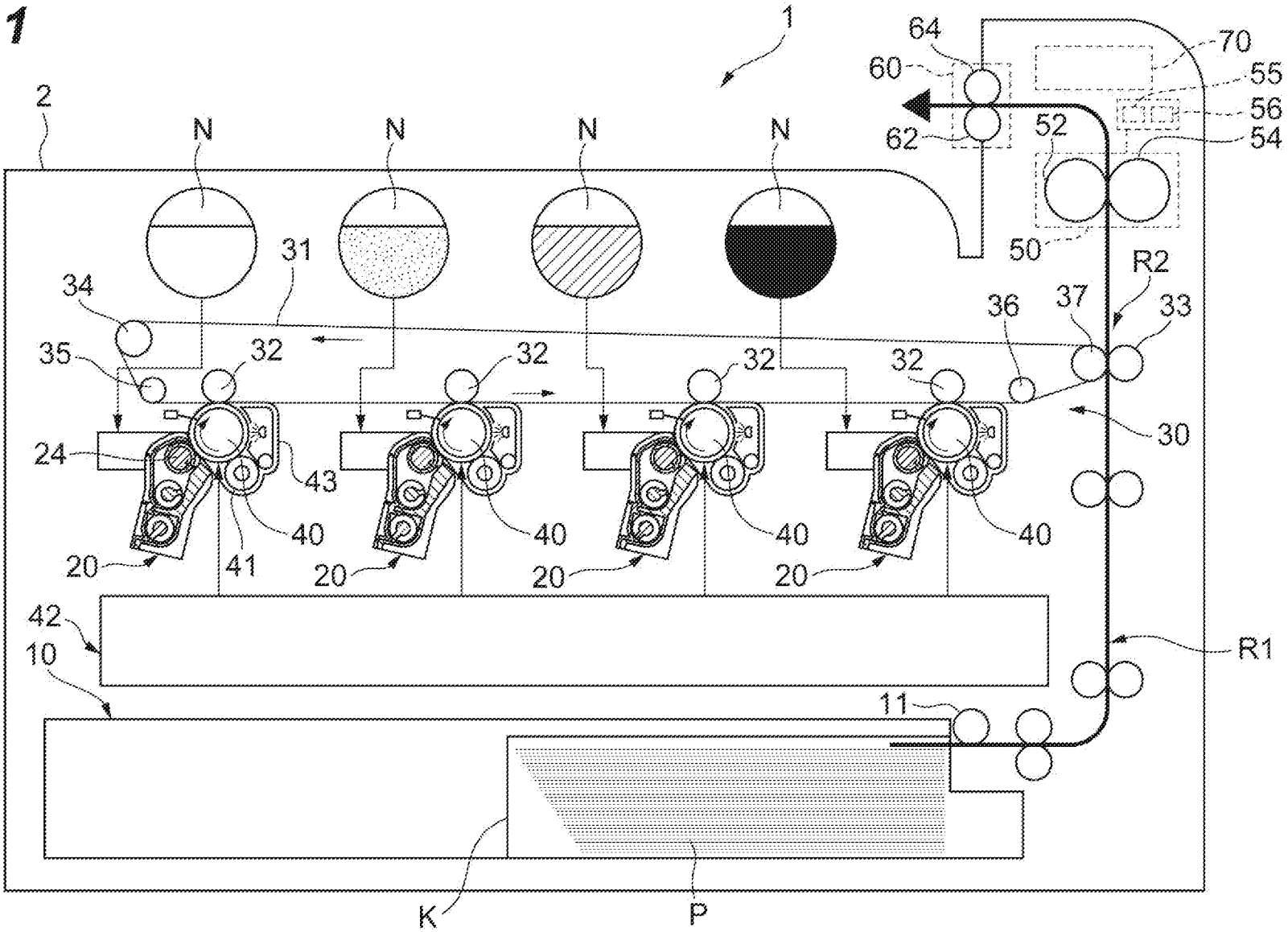
FIG. 1 is a schematic diagram of an example imaging system which can be used to carry out various examples disclosed in the present specification.

An imaging system 1 illustrated in FIG. 1 is, for example, an apparatus that forms a color image by using respective colors of magenta, yellow, cyan, and black. The imaging system 1 may include, for example, a housing 2, a conveying device 10 which conveys a printing medium P (such as a sheet of paper, for example), a developing device 20 which develops an electrostatic latent image, a transfer device 30 which transfers a toner image onto the printing medium P, an image carrier 40 on which an electrostatic latent image is formed, a fixing device 50 which fixes a toner image to the printing medium P, and a discharge device 60 which discharges the printing medium P. The housing 2 may accommodate the conveying device 10, the developing device 20, the transfer device 30, the image carrier 40, the fixing device 50, and the discharge device 60.

The conveying device 10 conveys, for example, the printing medium P having an image formed thereon along a conveying route R1. The printing media P are accommodated in, for example, a cassette K in a stacked state and are picked up and conveyed by a feeding roller 11. The conveying device 10 allows the printing medium P to reach a secondary transfer region R2 through the conveying route R1, for example, at a timing in which the toner image transferred onto the printing medium P reaches the secondary transfer region R2.

Four developing devices 20 may be provided for the four colors, respectively. Each example developing device 20 may include a developer carrier 24 which carries a toner on the image carrier 40. In the example developing device 20, a two-component developer including a toner and a carrier may be used as the developer. In the developing device 20, the toner and the carrier may be mixed to a target or selected ratio so that the toner is uniformly dispersed to adjust to a charge of the developer. Accordingly, the developer having an optimal charge amount is obtained. The developer is carried on the developer carrier 24. The developer carrier 24 rotates so that the developer is conveyed to a region facing the image carrier 40. Then, the toner of the developer carried on the developer carrier 24 moves to an electrostatic latent image formed on the peripheral surface of the image carrier 40 so that the electrostatic latent image is developed.

The transfer device 30 conveys, for example, the toner image developed by the developing device 20 to the secondary transfer region R2. The transfer device 30 includes, for example, a transfer belt 31 onto which a toner image is primarily transferred from the image carrier 40, tension rollers 34, 35, 36, and 37 which tension the transfer belt 31, a primary transfer roller 32 which sandwiches the transfer belt 31 together with the image carrier 40, and a secondary transfer roller 33 which sandwiches the transfer belt 31 together with the tension roller 37. The transfer belt 31 may include, for example, an endless belt which moves in a circulating manner by the tension rollers 34, 35, 36, and 37. Each of the tension rollers 34, 35, 36, and 37 is a roller which is rotatable about each axis. The tension roller 37 is, for example, a drive roller which rotates about an axis in a driving manner. The tension rollers 34, 35, and 36 are, for example, driven rollers which rotate in a driven manner in accordance with the rotational driving of the tension roller 37. The primary transfer roller 32 may, for example, press against the image carrier 40 from an inner peripheral side of the transfer belt 31. The secondary transfer roller 33 may extend in parallel to the tension roller 37 with the transfer belt 31 interposed therebetween and to press against the tension roller 37 from an outer peripheral side of the transfer belt 31. Accordingly, the secondary transfer roller 33 forms the secondary transfer region R2 corresponding to the transfer nip portion between the transfer belt 31 and the secondary transfer roller 33.

The image carrier 40 may be an electrostatic latent image carrier such as a photosensitive drum for example. Four image carriers 40 may be provided for the four colors, respectively. The image carriers 40 may be provided side by side, for example, spaced apart along the movement direction of the transfer belt 31. For example, the developing device 20, a charging roller 41, an exposure unit 42, and a cleaning device 43 are provided on the periphery of the image carrier 40.

The charging roller 41 may uniformly charge the surface of the image carrier 40 to a predetermined potential. The charging roller 41 may rotate so as to follow the rotation of the image carrier 40. The exposure unit 42 exposes, for example, the surface of the image carrier 40 charged by the charging roller 41. Accordingly, an electrical potential of a part exposed by the exposure unit 42 on the surface of the image carrier 40 changes so that an electrostatic latent image is formed. For example, the four developing devices 20 may each develop an electrostatic latent image from the toner supplied from a toner tank N that faces the corresponding developing device 20, so as to form a toner image. The respective toner tanks N are filled with, for example, magenta, yellow, cyan, and black toners, respectively. The cleaning device 43 collects, for example, the toner remaining on the image carrier 40 after the toner image formed on the image carrier 40 is primarily transferred onto the transfer belt 31.

The fixing device 50 allows, for example, the printing medium P to pass through the fixing nip portion, and heats and presses thereof so that the toner image secondarily transferred from the transfer belt 31 to the printing medium P is melted and fixed to the printing medium P. The fixing device 50 may include, for example, a heating roller 52 which heats the printing medium P and a pressing roller 54 which rotates in a driving manner while pressing the heating roller 52.

Each of the heating roller 52 and the pressing roller 54 is formed in, for example, a cylindrical shape and the heating roller 52 includes a heat source such as a halogen lamp provided therein. A fixing nip portion corresponding to a contact region is provided between the heating roller 52 and the pressing roller 54, and the printing medium P passes through the fixing nip portion so that the toner image is melted and fixed to the printing medium P.

The fixing device 50 is operated by receiving electric energy from a power supply and, for example, the imaging system 1 includes an energy measurement unit 55 which measures the electric energy to the fixing device 50. Further, the imaging system 1 may include a temperature measurement unit 56 which measures the temperature of the fixing device 50. The discharge device 60 includes, for example, discharge rollers 62 and 64 which discharge the printing medium P to which the toner image is fixed by the fixing device 50 to the outside of the apparatus.

An example printing process that may be carried out by the example imaging system 1 will be described. When a printing signal of a recording target image is input to the imaging system 1, a control unit (e.g., control device or controller) of the imaging system 1 actuates the feeding roller 11 to rotate, so that the printing media P stacked on the cassette K are picked up and conveyed. The surface of the image carrier 40 is uniformly charged to a predetermined potential by the charging roller 41 on the basis of a received printing signal (a charging operation). Subsequently, laser light is irradiated onto the surface of the image carrier 40 by the exposure unit 42 so that an electrostatic latent image is formed (an exposing operation).

In the example developing device 20, the electrostatic latent image is developed so that a toner image is formed (a developing operation). The toner image which is formed in this way is primarily transferred from the image carrier 40 to the transfer belt 31 at a region where the image carrier 40 faces the transfer belt 31 (a transfer operation). The toner images formed on four image carriers 40 are sequentially layered or superposed on the transfer belt 31 so that a single composite toner image is formed. Then, the composite toner image is secondarily transferred to the printing medium P conveyed from the conveying device 10 at the secondary transfer region R2 where the tension roller 37 faces the secondary transfer roller 33.

The printing medium P to which the composite toner image is secondarily transferred is conveyed to the fixing device 50. Then, the fixing device 50 heats and presses the printing medium P between the heating roller 52 and the pressing roller 54 when the printing medium P passes through the fixing nip portion so that the composite toner image is melted and fixed to the printing medium P (a fixing operation). Then, the printing medium P is discharged to the outside of the imaging system 1 by the discharge rollers 62 and 64.

Figure 2:
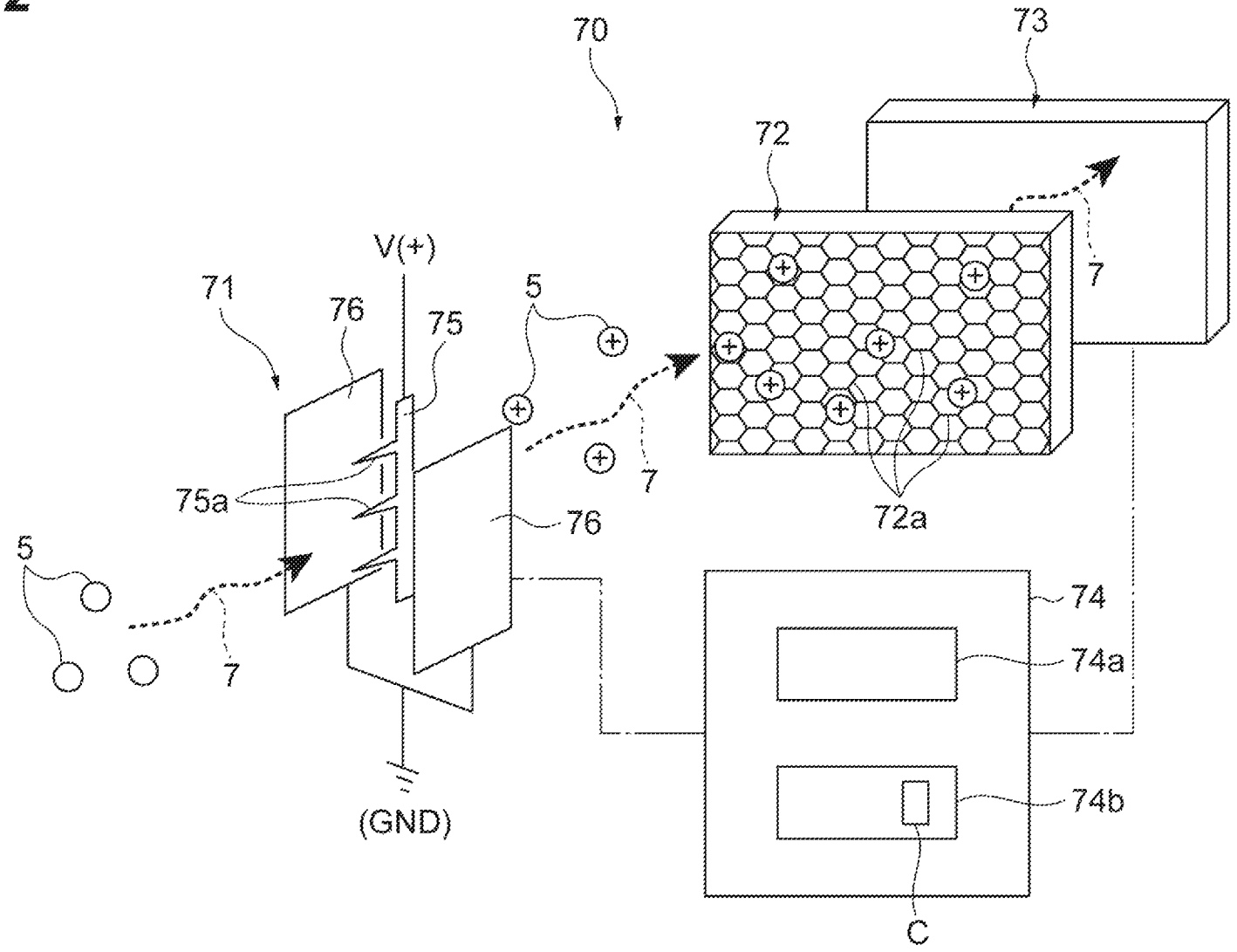
FIG. 2 is a perspective view of an example collection device with an ionizer of the imaging system of FIG. 1.

With reference to FIGS. 1 and 2, the imaging system 1 may include a collection device (or trapping device) 70. The collection device 70 is disposed in the vicinity of, for example, the fixing device 50 inside the housing 2 and traps particles floating inside the housing 2. The particles may have a size of about 50 nm to 300 nm and are ultrafine particles (UFP) 5. The UFP 5 can be generated, for example, as a result of the toner getting warmed up, for example, by the fixing device 50, the sheet, a component of the fixing device 50, or other peripheral components. The collection device 70 may be disposed at a position adjacent to the fixing device 50 where the generation amount of the UFP 5 is relatively large, in order to more effectively collect the UFP 5.

The example collection device 70 is a dust collection device which includes an ionizer 71, a particle filter 72, an exhaust fan 73, and a control unit (or controller) 74. The ionizer 71 includes, for example, a first electrode (a discharge electrode) 75 and a pair of second electrodes (counter electrodes) 76. The first electrode 75 and the second electrodes 76 are formed of stainless steel as an example.

A high voltage is applied to the first electrode 75 by a high-voltage power supply. The first electrode 75 includes a plurality of protrusions 75*a* used for a discharging process. The plurality of protrusions 75*a* are arranged, for example, at the same intervals. The protrusion 75*a* is formed in, for example, a saw blade shape or a needle shape. The pair of second electrodes 76 are grounded and disposed to face each other. The first electrode 75 is disposed between the pair of second electrodes 76. Furthermore, the configuration of the ionizer 71 is not limited to the example of FIG. 2 and can be appropriately changed.

In the ionizer 71, when the voltage applied to the first electrode 75 is less than a predetermined value, no current flows between the first electrode 75 and the second electrodes 76. However, when the voltage applied to the first electrode 75 is equal to or larger than the predetermined value, a discharge phenomenon occurs and a current flows between the first electrode 75 and the second electrodes 76. The ionizer 71 charges the UFP 5 passing between the first electrode 75 and the second electrodes 76 by the current. As the voltage applied to the first electrode 75 increases, the amount of the current flowing between the first electrode 75 and the second electrodes 76 increases.

The control unit (or controller) 74 controls the ionizer 71. For example, the magnitude of the voltage applied to the first electrode 75 may be controlled by the control unit 74. The control unit 74 may perform constant current control by controlling, for example, the high-voltage power supply. In some examples, the control unit 74 controls the magnitude of the voltage applied to the first electrode 75 so that the amount of the current flowing between the first electrode 75 and the second electrodes 76 reaches a predetermined target value. In some examples, the control unit 74 controls the magnitude of the voltage applied to the first electrode 75 by changing, for example, a duty ratio of a PWM signal input to the high-voltage power supply.

In the ionizer 71, the tip of the first electrode 75 may deteriorate (e.g., become degraded) with use. When the tip is deteriorated with use, the amount of the current flowing between the first electrode 75 and the second electrodes 76 changes even when the voltage application amount is the same. When constant current control is performed, the current amount may be more stably adjusted to a target value even when the tip of the first electrode 75 is deteriorated or becomes degraded.

In some example, the particle filter 72 is, for example, a laminate of polymer sheets subjected to an electret process and includes a plurality of air passages 72*a* formed in a tubular shape. The surface of the particle filter 72 is semi-permanently charged. As a result, the particle filter 72 can collect the UFP 5 charged by the ionizer 71. For example, even if the particle filter 72 is coarse, the UFP 5 may be collected by the Coulomb force.

The electret process is, for example, a process of causing a polymer material to have a charge holding structure by solidifying the heat-melted polymer material while applying a high voltage thereto. The particle filter 72, for example, as illustrated in FIG. 2, may have a honeycomb structure or a corrugated structure.

In some examples, the exhaust fan 73 is an air flow generator which generates an air flow 7 for transferring the UFP 5. For example, the exhaust fan 73 may be in an air-communication state with respect to the outside of the housing 2 and may be disposed inside an opening formed in the housing 2. For example, the ionizer 71 and the particle filter 72 are disposed between the exhaust fan 73 and the fixing device 50. The exhaust fan 73 may be disposed on the side opposite to the ionizer 71 when viewed from the particle filter 72. The exhaust fan 73 generates the air flow 7 so that the UFP 5 charged by the ionizer 71 is transferred to the particle filter 72.

In some examples, the control unit 74 is electrically connected to the ionizer 71 and controls the operation of the ionizer 71. The control unit 74 may control, for example, the magnitude of the voltage applied to the first electrode 75 and the operation of the exhaust fan 73. The controller or control unit 74 may be configured as, for example, a computer including a processor 74*a* such as a central processing unit (CPU) and a storage unit 74*b* such as a read-only memory (ROM) or a random access memory (RAM).

As an example, the storage unit 74*b* stores a current control program C. The storage unit 74*b* includes, for example, a non-transitory computer readable storage device (storage medium) storing the current control program C. For example, the control unit 74 achieves the current control to the ionizer 71 by reading and executing the current control program C using the processor 74*a*.

Figure 3:
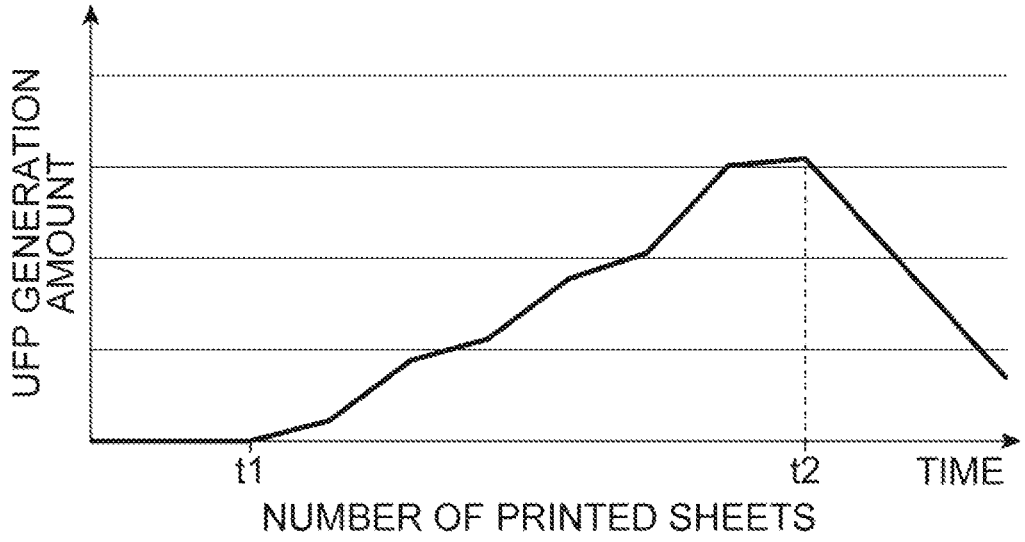
FIG. 3 is a graph showing an example relationship of the number of printed sheets, a time, and an amount of ultrafine particles (UFP) generated.

With reference to FIG. 3, the UFP generation amount increases as the number of printed sheets of the imaging system 1 increases. However, the UFP generation amount does not increase immediately after the imaging system 1 starts a printing operation, but the UFP is generated once a predetermined time t1 elapses since the start of the printing operation.

No UFP is generated until the arrival of the predetermined time t1 because the predetermined time t1 is needed to heat the UFP generation source to a predetermined temperature in the fixing device 50. The amount of the UFP is gradually increased once the predetermined time t1 elapses, but is gradually decreased at a time t2 when the printing operation ends. For example, since a plurality of UFP are aggregated or the UFP are attached to a wall or the like after the printing operation ends, the amount of UFP generated is gradually decreased.

When a plurality of printing jobs are performed by the imaging system 1, the amount of the UFP is decreased as the elapsed time from the last printing operation (e.g., the interval time of subsequent printing jobs) increases. For example, the "printing job" may indicate a unit of a printing operation that prints one or more sheets at one time and may indicate a collection of one or more sheets grouped together in a predetermined relationship. The "printing job" may have an attribute, and the "attribute" has, for example, an attribute set before a printing operation, such as a sheet type (e.g., thick sheet or thin sheet), color or monochrome, single-sided printing or double-sided printing, and the like. For example, when the printing medium is a thick sheet, the amount of heat generated in the fixing device 50 increases and the time it takes to generate the UFP starts is shortened as compared with a case employing a thin sheet. At this time, the ionizer 71 may be turned on. In this way, the ON/OFF state of the ionizer 71 may be controlled in response to the attribute.

Figure 4:
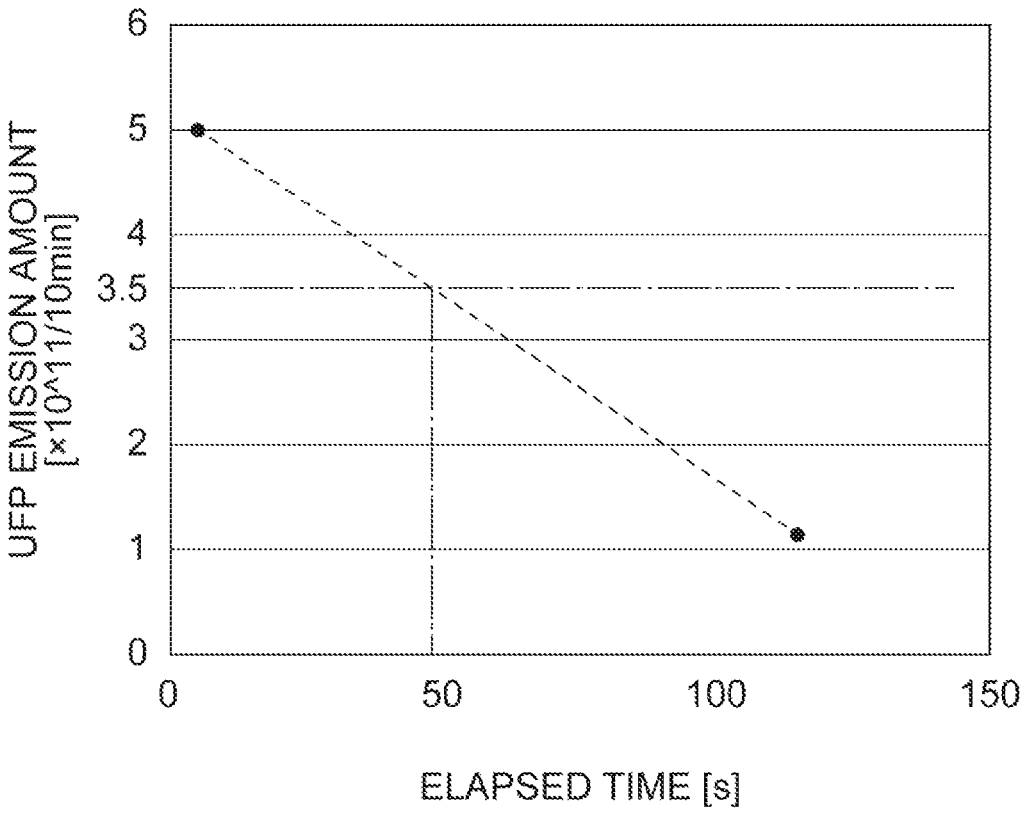
FIG. 4 is a graph showing an example relationship of a UFP emission amount and an elapsed time between a plurality of printing jobs.

The "elapsed time from the final printing operation" may refer to an elapsed time from the last printing operation, such as the time from the last printing operation to a printing operation succeeding the last printing operation. FIG. 4 is a graph showing an example of a relationship of the elapsed time from the final printing operation and the UFP emission amount (e.g., particle emission rate). As shown in FIG. 4, when the elapsed time from the final printing operation increases, the UFP emission amount gradually decreases. For example, when the elapsed time is 50 seconds or more, the UFP emission amount is $3.5\times10^{11}$ (number of particles/10 min) or less. In the imaging system 1, the OFF/OFF state of the ionizer 71 is controlled so that, for example, the UFP emission amount is $3.5\times10^{11}$ (number of particles/10 min) or less.

For example, when the elapsed time from the final printing operation is 0 second or more and less than 50 seconds, the UFP emission amount is larger than $3.5\times10^{11}$ (number of particles/10 min). Then, when the elapsed time from the final printing operation exceeds 50 seconds, the UFP emission amount decreases to $3.5\times10^{11}$ (number of particles/10 min) or less. Thus, when the elapsed time from the final printing operation is less than 50 seconds, the influence of the UFP generated by the last printing job is large. Further, when the elapsed time from the final printing operation is 120 seconds or more, the UFP emission amount becomes $1.0\times10^{11}$ (number of particles/10 min) or less. As a result, there may be substantially no influence of the UFP generated by the last printing job.

Figure 5:
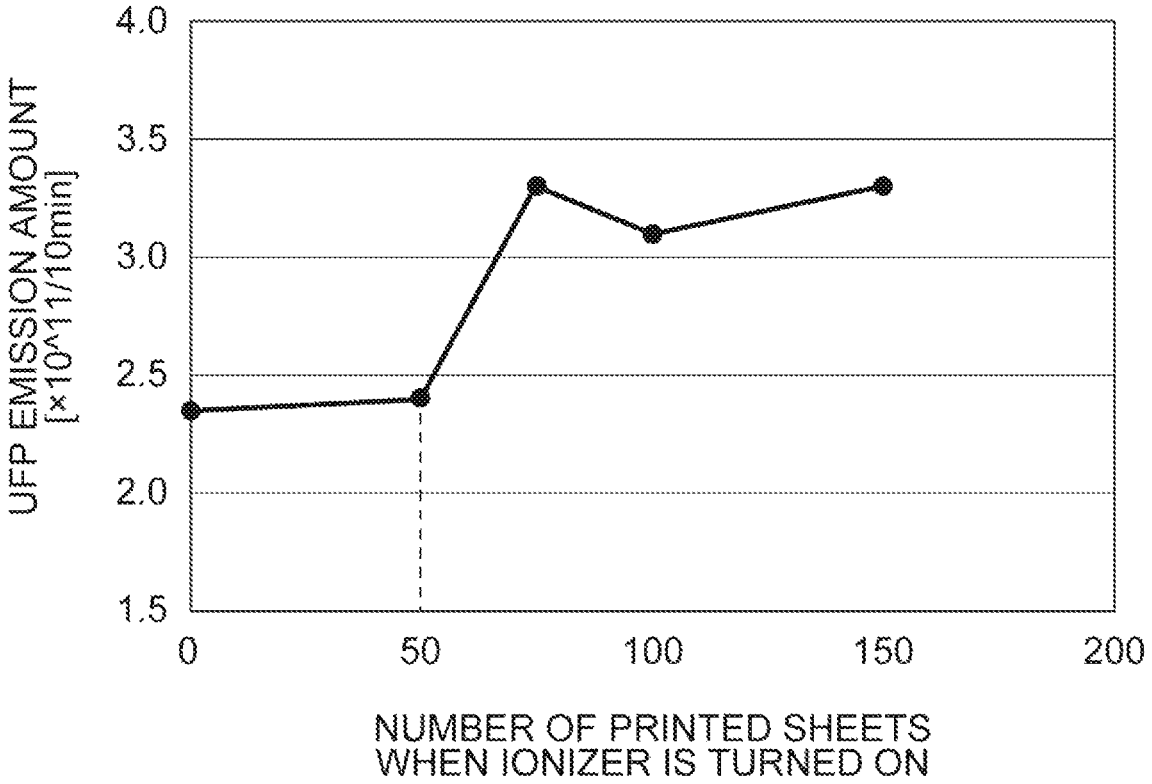

FIG. 5 is a graph showing a relationship of the number of printed sheets and the UFP emission amount (e.g., of the maximum value) when the ionizer 71 is turned on. As shown in FIG. 5, there was substantially no difference in UFP emission amount between when the ionizer 71 was turned on and the number of printed sheets was 0 and when the ionizer 71 was turned on and the number of printed sheets was 50. At this time, the UFP emission amount was about $2.4\times10^{11}$ (number of particles/10 min).

Further, the UFP emission amount was about $3.3\times10^{11}$ (number of particles/10 min) when the number of printed sheets was 75 or 150 after the ionizer 71 was turned on and the UFP emission amount was about $3.1\times10^{11}$ (number of particles/10 min) when the number of printed sheets was 100 after the ionizer 71 was turned on. In this way, it was found that the UFP emission amount increased if the ionizer 71 was turned on when the number of printed sheets exceeded 50.

As described above, since the amount of the UFP does not increase until the predetermined time t1 since the start of the printing operation, the UFP emission amount is suppressed even when the ionizer 71 is turned on after the elapsed time from the final printing operation reaches 50 seconds, and the UFP emission amount is suppressed even when the ionizer 71 is turned on when the number of printed sheets is 50, the control unit 74 selects the ON/OFF state of the ionizer 71 in response to the elapsed time from the final printing operation and the number of printed sheets (the cumulative number of printed sheets). Accordingly, an unnecessary operation of the ionizer 71 can be suppressed. An example of the control of the ionizer 71 by the control unit (controller) 74 will be described.

In some examples, the control unit 74 includes, for example, a timer and a counter, and the counter counts a cumulative number of media printed, such as the number of printed sheets. The timer resets and stops the timer itself and changes to a ground state, for example, when a predetermined time (e.g., an elapsed time described later as an example) elapses. The ground state indicates a state in which the counter is reset, the number of printed sheets is 0, and the timer is stopped. For example, the control unit 74 resets and starts the timer when a printing signal is input. For example, in the control unit 74, the printed sheet number counting process of the counter is combined with the elapsed time measurement process of the timer, and the printed sheet number counting process and the elapsed time measurement process are operated in a non-synchronization manner. Thus, in the control unit 74, the elapsed time measurement process is in operation even while waiting for a printing signal, and the printed sheet number counting process is in operation when the printing signal is input.

Figure 6:
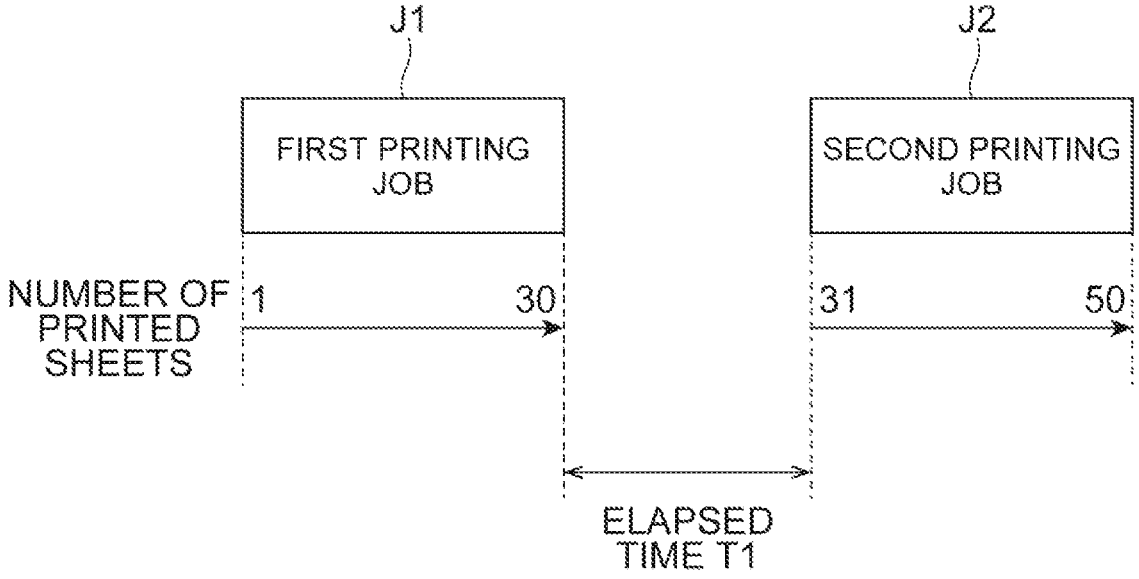
FIG. 6 is a schematic diagram illustrating a relationship of example first and second printing jobs, an elapsed time, and the number of printed sheets.
Figure 7:
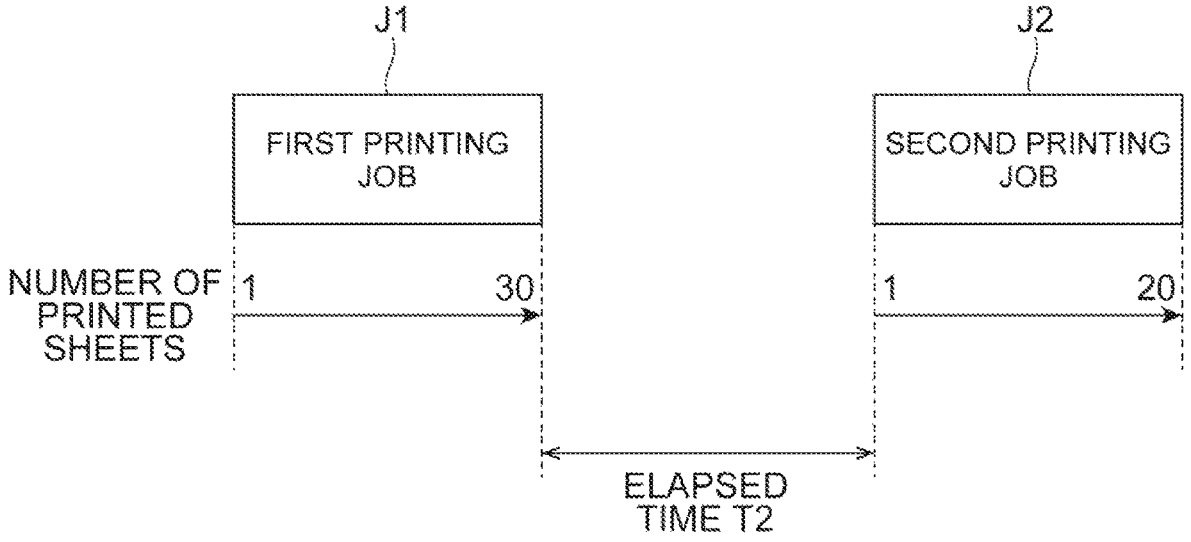
FIG. 7 is a schematic diagram illustrating a relationship of example first and second printing jobs, an elapsed time, and the number of printed sheets.

FIGS. 6 and 7 are diagrams respectively illustrating an example operation when the imaging system 1 performs a last printing operation and a next printing operation. An example operation of counting (e.g., adding) the cumulative number of printed sheets, which is carried out by the control unit 74 when the imaging system 1 performs a first printing job J1 and a second printing job J2, will be described. As an example, thirty sheets are printed in the first printing job J1 (e.g., the last printing operation) and twenty sheets are printed in the second printing job J2 (e.g., the next printing operation).

In some examples, the control unit 74 counts the cumulative number of printed sheets and turns on the ionizer 71 when the number of printed sheets becomes a predetermined number of sheets or more. As an example, the control unit 74 may turn on the ionizer 71 when the number of printed sheets is 50 or more. The control unit 74 continuously counts the number of printed sheets when it is determined that the elapsed time T1 (the elapsed time from the final printing operation) is not a predetermined time or more, and resets the number of printed sheets when it is determined that the elapsed time T2 (the elapsed time from the final printing operation) is the predetermined time or more.

In the examples of FIGS. 6 and 7, when the elapsed time T1 after the first printing job J1 ends is not a predetermined time or more (for example, less than 50 seconds), the control unit 74 adds the number of printed sheets of the second printing job J2 from a value at the time of ending the first printing job J1. Meanwhile, when the elapsed time T2 since the end of the first printing job J1 is equal to or more than a predetermined time (for example, 50 seconds or more), the control unit 74 resets the number of printed sheets to 0 before the second printing job J2 is performed.

Figure 8:
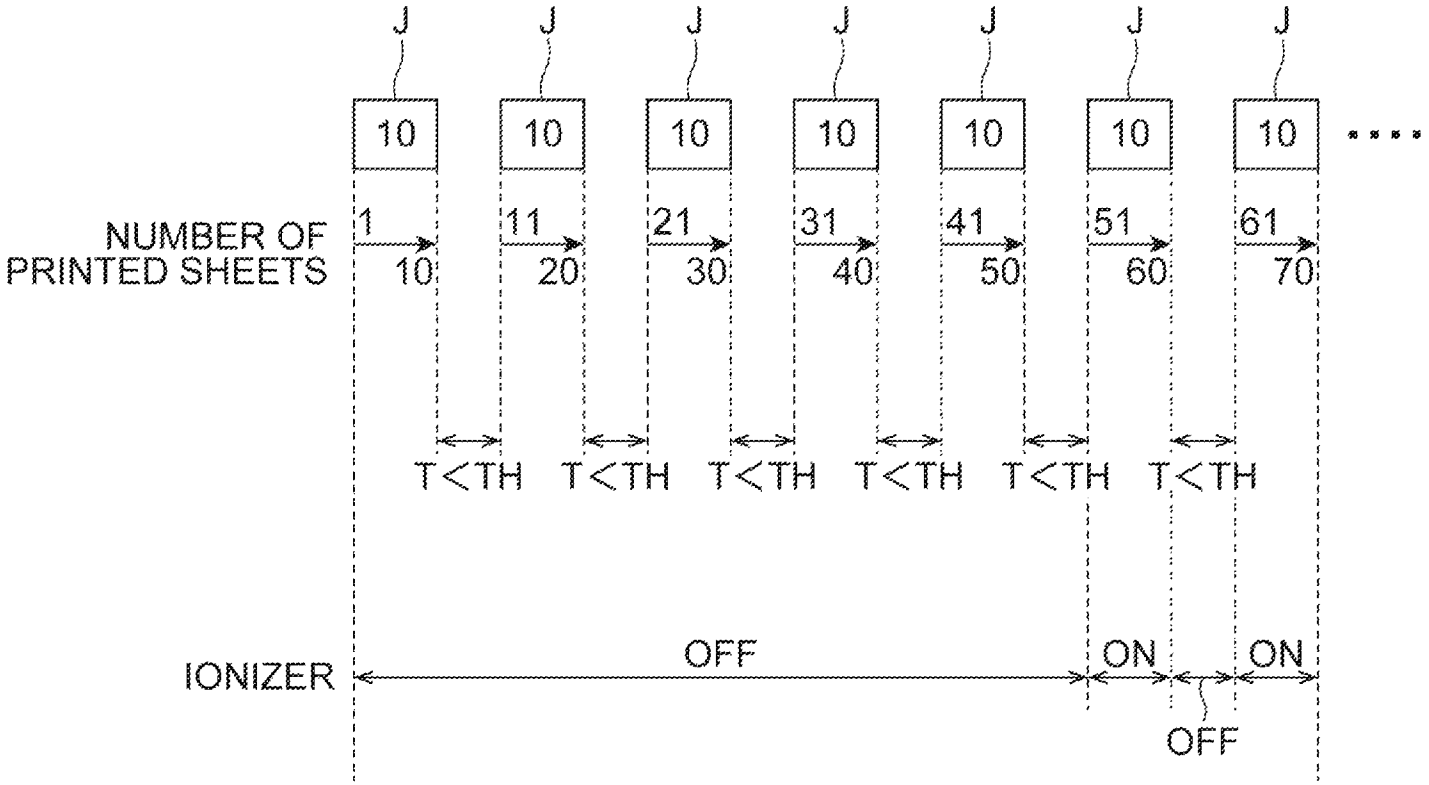
FIG. 8 is a diagram illustrating an example relationship of the number of printed sheets, an elapsed time, and ON/OFF control of an ionizer when a plurality of printing jobs are performed.

FIG. 8 illustrates an example of the ON/OFF control of the ionizer 71 and the counting of the number of printed sheets of the control unit 74 when the imaging system 1 performs a plurality of printing jobs J. As an example, ten sheets are printed in each printing job J. First, when the number of printed sheets corresponds to a predetermined number of sheets (for example, fifty sheets) or less, the control unit 74 turns off the ionizer 71 after the first printing job J starts.

The control unit 74 compares each elapsed time T from the final printing operation with a predetermined time TH and counts (e.g., adds) the number of printed sheets when the elapsed time T is less than the predetermined time TH. The predetermined time TH is fifty seconds as an example. In the example of FIG. 8, since the elapsed time T between the plurality of printing jobs J is less than the predetermined time TH, the control unit 74 counts the number of printed sheets without any reset.

Then, the control unit 74 turns on the ionizer 71 when the number of printed sheets reaches the predetermined number of sheets or more and the next printing job J starts. In the example of FIG. 8, the ionizer 71 is turned on when the number of printed sheets reaches 50 or more and the printing job J starts and the ionizer 71 is turned off when the printing job J ends. Since the elapsed time T is less than the predetermined time TH even after that, the control unit 74 turns on the ionizer 71 again when the next printing job J starts.

Figure 9:
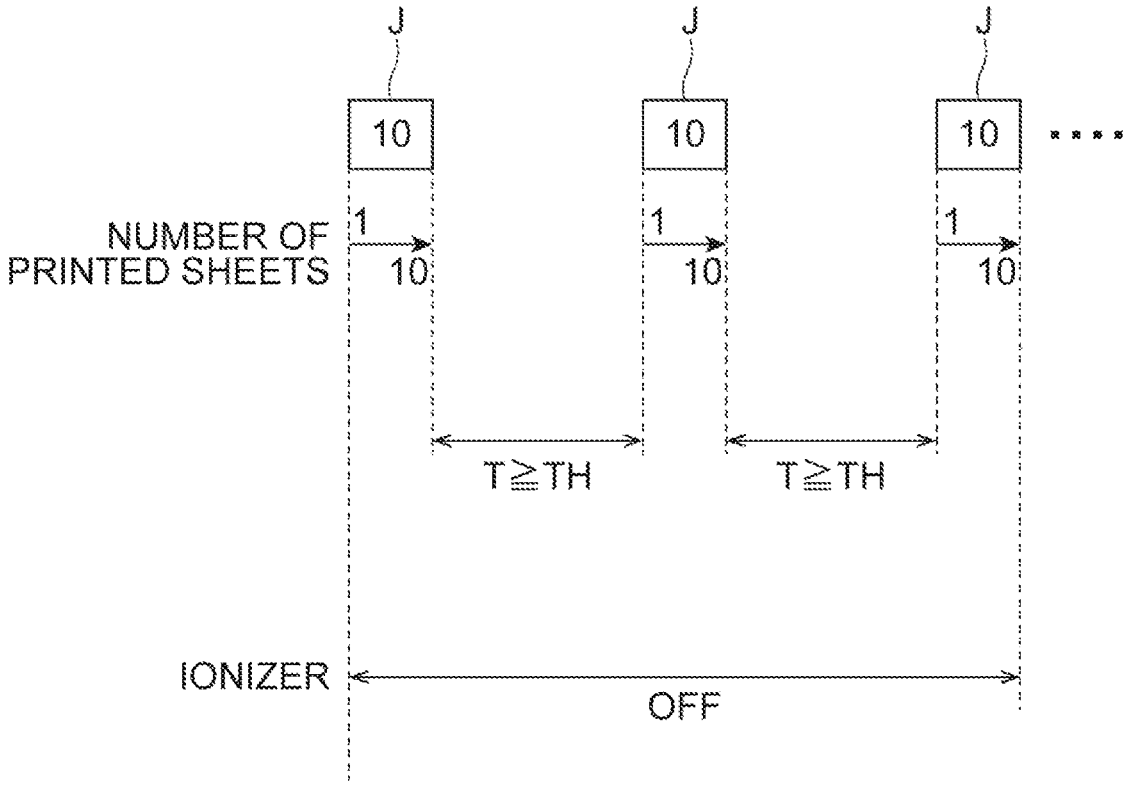
FIG. 9 is a diagram illustrating an example of a relationship of the number of printed sheets, an elapsed time, and ON/OFF control of an ionizer when a plurality of printing jobs are performed.

FIG. 9 illustrates another example of the ON/OFF control of the ionizer 71 and the counting of the number of printed sheets of the control unit 74 when the imaging system 1 performs a plurality of printing jobs J. The control unit 74 compares each elapsed time T from the final printing operation with a predetermined time TH and resets the number of printed sheets to zero when the elapsed time T is the predetermined time TH or more. In the example of FIG. 9, since the elapsed time T between the plurality of printing jobs J is the predetermined time TH or more, the control unit 74 resets the number of printed sheets when the printing job J ends and the next printing job J starts.

Figure 10:
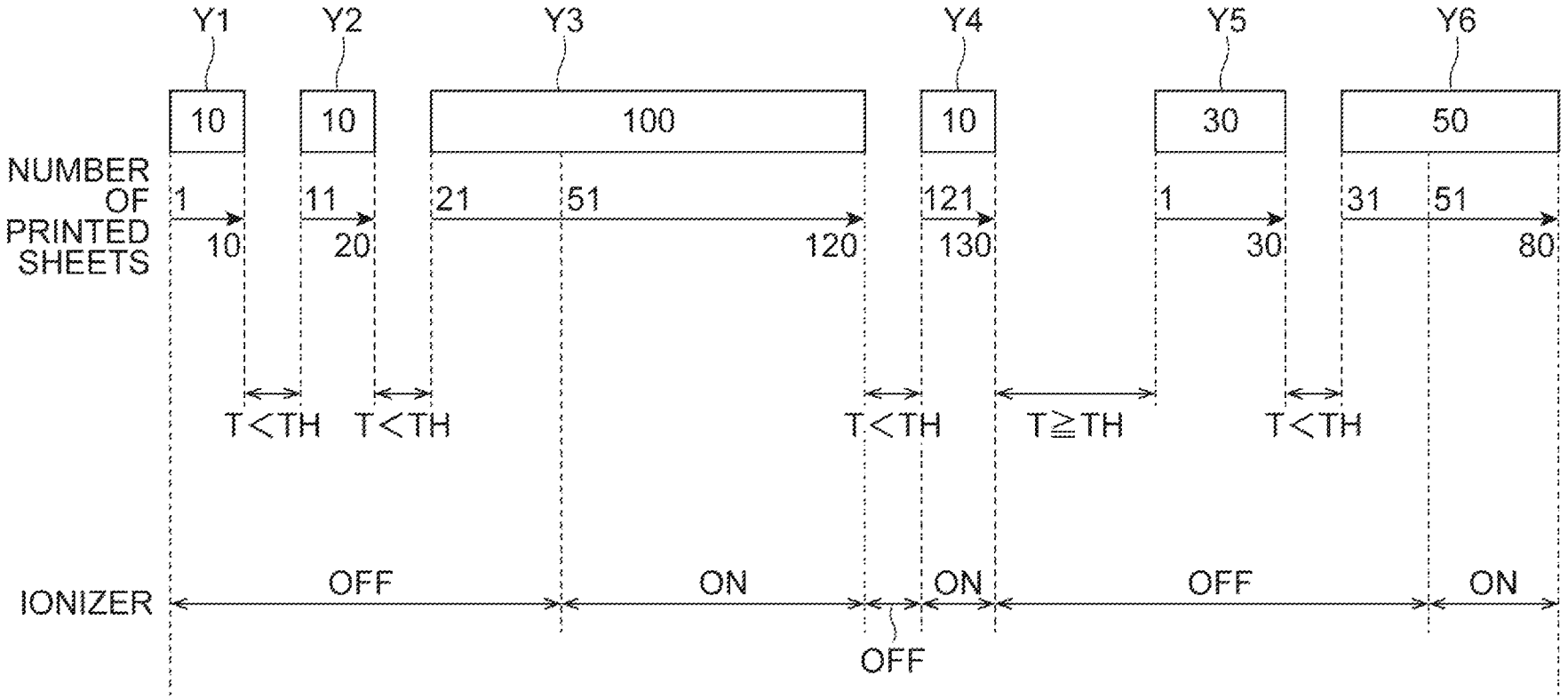
FIG. 10 is a diagram illustrating an example of a relationship of the number of printed sheets, an elapsed time, and ON/OFF control of an ionizer when a plurality of printing jobs are performed.

FIG. 10 illustrates still another example of the ON/OFF control of the ionizer 71 and the counting of the number of printed sheets of the control unit 74. With reference to the example of FIG. 10, a first printing job Y1 in which the number of printed sheets is 10, a second printing job Y2 in which the number of printed sheets is 10, a third printing job Y3 in which the number of printed sheets is 100, a fourth printing job Y4 in which the number of printed sheets is 10, a fifth printing job Y5 in which the number of printed sheets is 30, and a sixth printing job Y6 in which the number of printed sheets is 50 are sequentially performed.

Since the elapsed time T from the final printing operation is shorter than the predetermined time TH after performing the first printing job Y1 and the second printing job Y2, the control unit 74 counts the number of printed sheets of each of the first printing job Y1 and the second printing job Y2. However, since the number of printed sheets is less than the predetermined number of sheets after performing the first printing job Y1 and the second printing job Y2, the control unit 74 does not turn on the ionizer 71.

When the third printing job Y3 starts, the control unit 74 counts the number of printed sheets from the value at the time of ending the second printing job Y2. Then, when the number of printed sheets reaches the predetermined number of sheets or more (for example, fifty sheets or more), the ionizer 71 is turned on. Accordingly, the control unit 74 may turn on the ionizer 71 during the printing job. In this case, when it is necessary to remove the UFP 5, the ionizer 71 can be turned on promptly.

When the third printing job Y3 ends and the fourth printing job Y4 starts, since the elapsed time T is shorter than the predetermined time TH and the number of printed sheets is equal to or more than the predetermined number of sheets, the control unit 74 counts the number of printed sheets and turns on the ionizer 71. Then, the control unit 74 turns off the ionizer 71 after the fourth printing job Y4 ends.

Since the elapsed time T is equal to or more than the predetermined time TH after performing the fourth printing job Y4, the control unit 74 resets the number of printed sheets to zero. Then, the control unit 74 starts the counting of the number of printed sheets from zero once the fifth printing job Y5 starts and turns on the ionizer 71 when the number of printed sheets is equal to or more than the predetermined number of sheets once the sixth printing job Y6 starts. As described above, the control unit 74 selects the ON/OFF state of the ionizer 71 in response to the value of the number of printed sheets.

Figure 11:
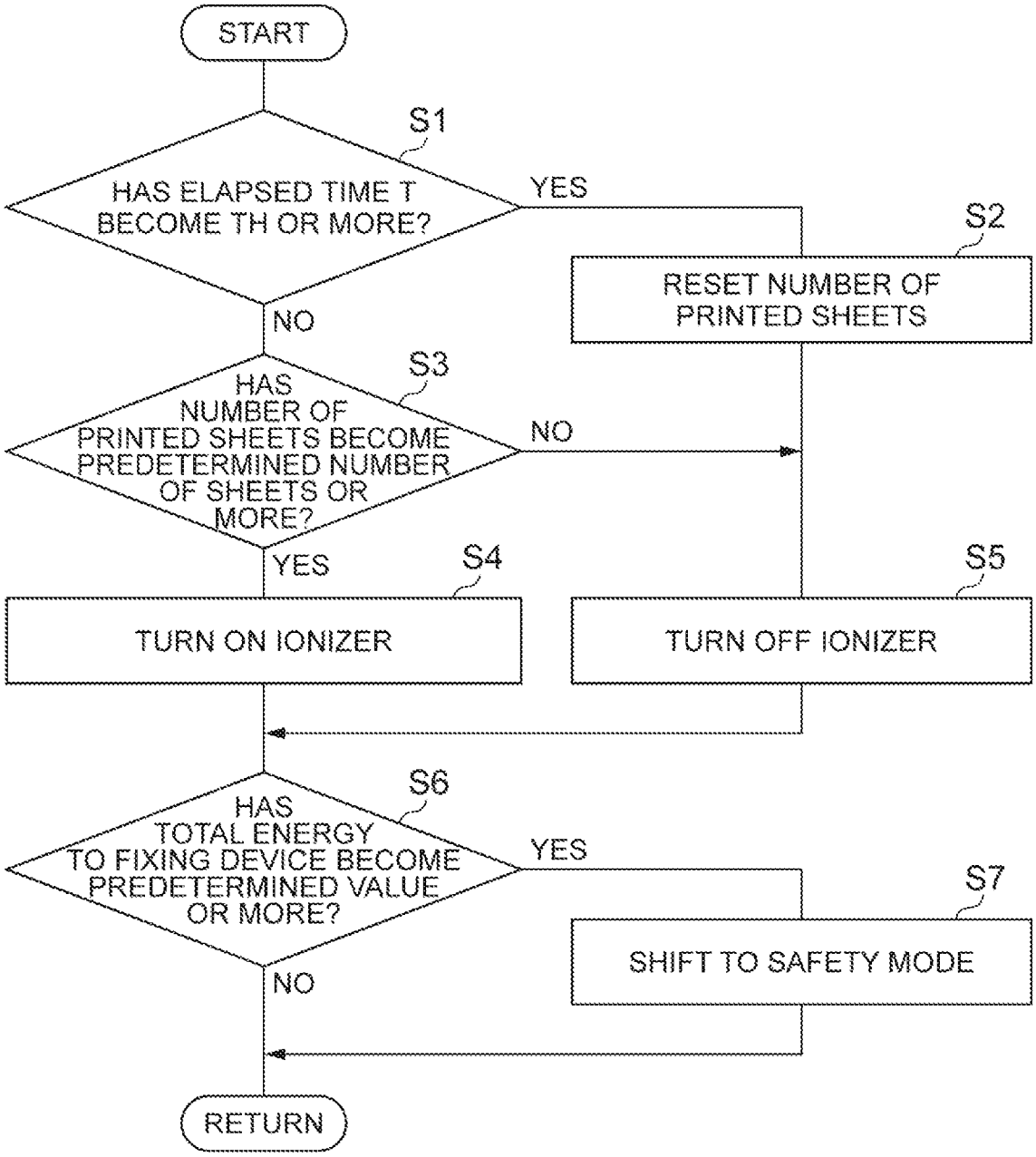
FIG. 11 is a flowchart illustrating an example of ON/OFF control of an ionizer and operation control of a fixing device.

An example of the control operation of the ionizer 71 of the control unit 74 and the example control operation of the fixing device 50 will be described with reference to the flowchart of FIG. 11. The operations of the flowchart illustrated in FIG. 11 are performed when the imaging system 1 performs a plurality of printing jobs. For example, the control unit 74 counts the number of printed sheets after the imaging system 1 is turned on and the first printing job is performed. For example, the control unit 74 operates the printed sheet number counting process of the counter when a printing signal is input.

The control unit 74 operates the elapsed time measurement process of the timer so as to measure the elapsed time T and determines whether the elapsed time T from the final printing operation is a predetermined time TH or more (operation S1). When the control unit 74 determines that the elapsed time T is the predetermined time TH or more (YES in operation S1), the number of printed sheets is reset (operation S2). For example, the value of the number of printed sheets of the counter is reset to zero. Further, when the control unit 74 determines that the elapsed time T is not the predetermined time TH or more (NO in operation S1), it is determined whether the number of printed sheets is a predetermined number of sheets or more (operation S3).

When the control unit 74 determines that the number of printed sheets is the predetermined number of sheets or more (YES in operation S3), it is determined that the UFP scattered amount has increased and the ionizer 71 is turned on (operation S4). Meanwhile, when the control unit 74 determines that the number of printed sheets is not the predetermined number of sheets or more (NO in operation S3), it is determined that the UFP scattered amount is low and the ionizer 71 is turned off (operation S5).

After operation S4 or operation S5, for example, it is determined whether the electric energy to the fixing device 50 measured by the energy measurement unit 55 is a predetermined value or more (operation S6). When it is determined that the electric energy to the fixing device 50 (for example, the total amount of the electric energy) is the predetermined value or more, the imaging system 1 shifts to a safety mode as the UFP scattered amount increases (operation S7). The safety mode includes, for example, an operation of pausing the printing job in execution or an operation of decreasing a printing speed.

When it is determined that the electric energy to the fixing device 50 is a predetermined value or more (YES in operation S6), a series of operations end after shifting to the safety mode. Further, when it is determined that the electric energy to the fixing device 50 is less than the predetermined value (NO in operation S6), a series of operations end without shifting to the safety mode.

Instead of operation S6, for example, it may be determined whether the temperature of the fixing device 50 measured by the temperature measurement unit 56 is a predetermined temperature or more. When it is determined that the temperature of the fixing device 50 is the predetermined temperature or more, the imaging system 1 may shift to the safety mode as the UFP scattered amount increases. Further, when it is determined that the temperature of the fixing device 50 is not the predetermined temperature or more, a series of operations may end without shifting to the safety mode.

In the example imaging system 1, with the above-described configuration, the control unit 74 counts the number of printed sheets and turns on the ionizer 71 when the number of printed sheets is equal to or more than a predetermined number of sheets. In the example, the control unit 74 counts the number of printed sheets by adding the number of printed sheets in the second printing job to the number of printed sheets in the first printing job and selects the ON/OFF state of the ionizer 71 on the basis of the number of printed sheets. Thus, the ionizer 71 may be turned off when it is unnecessary to operate the ionizer 71.

Figure 12:
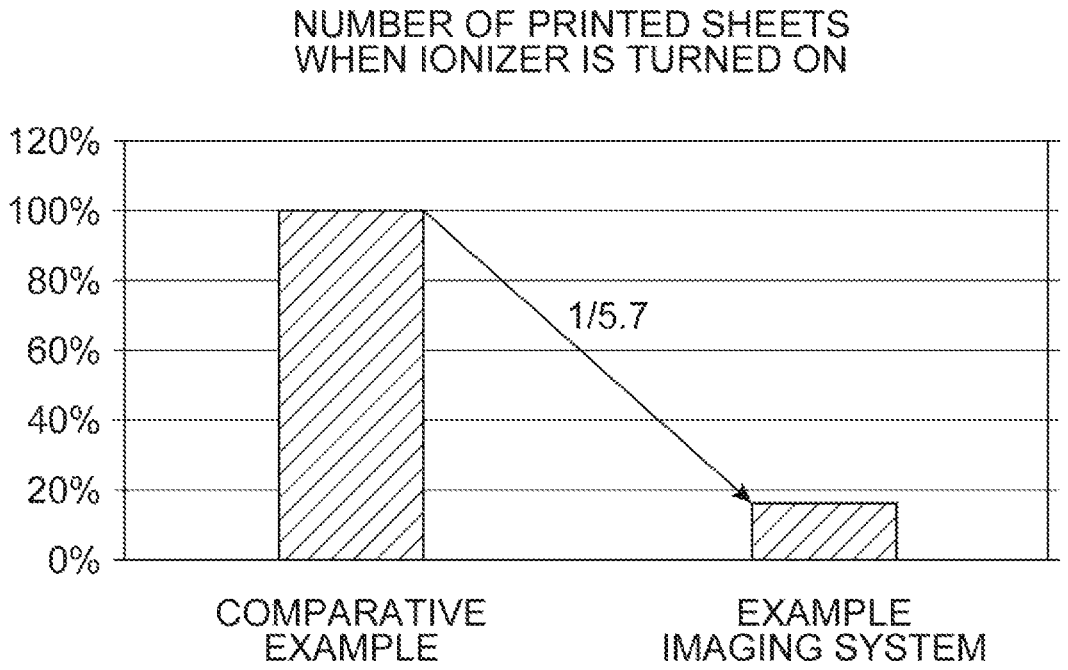
FIG. 12 is a graph showing an example of the number of the printed printing media while an ionizer is turned on, in an example imaging system, and in a comparative example.

For example, as shown in FIG. 12, in the example imaging system 1, the number of printed sheets processed during the operation of the ionizer 71 can be suppressed to (1/5.7), for example, 20% or less as compared with the imaging system of the comparative example that turns on the ionizer at all times during the printing job. In this way, in the imaging system 1, since the ionizer 71 can be turned off in unnecessary cases, the power consumption may be suppressed and the longevity of the ionizer 71 may be increased.

Specifically, the first electrode 75 of the ionizer 71 includes the plurality of protrusions 75*a*. The protrusions 75*a* of the first electrode 75 may become dirty over time and the lifetime of the ionizer 71 may be shortened as the operation time of the ionizer 71 increases. However, in the imaging system 1, since the number of printed sheets processed during the operation of the ionizer 71 can be set to 20% or less, the lifetime of the ionizer 71 can be five times or more.

As described above, the ionizer 71 may be turned on when the number of printed sheets becomes equal to or greater than a predetermined number of sheets and the UFP generation amount is large. Thus, the generation of UFP in a large amount may be effectively suppressed by the ionizer 71.

Conversely, when the number of printed sheets is low and the UFP generation amount is low, the ionizer 71 may remain turned off. Thus, since the unnecessary operation of the ionizer 71 is suppressed or reduced, the lifetime of the ionizer 71 may be prolonged.

The control unit 74 may turn off the ionizer 71 when it is determined that the elapsed time T from the final printing operation is equal to or more than the predetermined time TH. In this case, when it is assumed that the elapsed time from the last printing operation to the next printing operation is the predetermined time TH or more and the amount of the UFP is considerably low, the ionizer 71 may remain turned off. Thus, the unnecessary operation of the ionizer 71 can be reliably suppressed.

The control unit 74 may turn on the ionizer 71 when the printing operation starts and the number of printed sheets becomes equal to or more than the predetermined number of sheets. The control unit 74 may turn off the ionizer 71 when the printing operation starts and the number of printed sheets is less than the predetermined number of sheets, and reset the number of printed sheets when the elapsed time T from the final printing operation is greater than the predetermined time TH. In this case, the ionizer 71 can be turned on and off with high accuracy by using the number of printed sheets and the elapsed time T. Accordingly, the UFP generation amount may be more reliably reduced while suppressing the unnecessary operation of the ionizer 71.

The control unit 74 may turn on the ionizer 71 when it is determined that the elapsed time T from the final printing operation is less than a predetermined time TH. In this case, the ionizer 71 can be turned on when the elapsed time T corresponding to the time interval with the last printing operation is short. Thus, since the ionizer 71 can be operated when the elapsed time T is short and the amount of the UFP is large, an increase in UFP scattered amount may be more reliably suppressed.

The control unit 74 may reset the number of printed sheets and turn off the ionizer 71 when it is determined that the elapsed time T from the final printing operation is equal to or greater than the predetermined time TH. In this case, when the elapsed time T is equal to or greater than the predetermined time or more and the time from the last printing operation elapses for a long time, the number of printed sheets can be reset to zero and the ionizer 71 can be turned off. Thus, when the time from the last printing operation is long and the UFP scattered amount is low, the ionizer 71 can be turned off. As a result, since the ionizer 71 is turned off when the UFP generation amount is low, the unnecessary operation of the ionizer 71 may be more reliably suppressed or reduced.

The control unit 74 may compare the number of printed sheets with the predetermined number of sheets when the elapsed time T from the final printing operation is less than the predetermined time TH, and may turn on the ionizer 71 when it is determined that the number of printed sheets is the predetermined number of sheets or more. In this case, the ionizer 71 can be turned on and off with better accuracy on the basis of the elapsed time T and the number of printed sheets.

In some examples, the imaging system 1 may include the energy measurement unit 55 which measures the electric energy supplied to the fixing device 50 and the control unit 74 may perform an operation of pausing a printing operation in execution or an operation of decreasing a printing speed when the electric energy to the fixing device 50 measured by the energy measurement unit 55 becomes a predetermined value or more. In this case, when it is assumed that the electric energy to the fixing device 50 increases and the UFP scattered amount is large, the routine can be shifted to the safety mode of suppressing the UFP scattered amount. Thus, the excessive generation of the UFP can be suppressed. The energy measurement unit 55 may determine an average power consumed by the fixing device 50 during a predetermined time. For example, the energy measurement unit 55 may calculate the measured power as an average value. In this case, the energy consumed by the fixing device 50 can be used as an average value.

The imaging system 1 includes the temperature measurement unit 56 which measures the temperature of the fixing device 50 and the control unit 74 may perform an operation of pausing a printing operation in execution or an operation of decreasing a printing speed when the temperature of the fixing device 50 measured by the temperature measurement unit 56 reaches a predetermined temperature or more. In this case, when it is assumed that the temperature of the fixing device 50 is high and the UFP scattered amount is large, the routine can be shifted to the safety mode of suppressing the UFP scattered amount. Thus, the excessive generation of the UFP can be suppressed.

The control unit 74 may turn on the ionizer 71 when the temperature of the fixing device 50 measured by the temperature measurement unit 56 is a predetermined temperature or more. In this case, since the control unit 74 can turn on the ionizer 71 when the temperature of the fixing device 50 is high and the possibility of generating the UFP is high, an increase in UFP generation amount may be more reliably suppressed. Further, the control unit 74 may turn off the ionizer 71 when the temperature of the fixing device 50 measured by the temperature measurement unit 56 becomes lower than a predetermined temperature. In this case, since the ionizer 71 can be turned off when the temperature of the fixing device 50 is low and the UFP generation amount decreases, the unnecessary operation of the ionizer 71 may be more reliably suppressed.

The control unit 74 may select the ON/OFF state of the ionizer 71 so that the particle emission rate of the UFP is reduced to $3.5\times10^{11}$ (number of particles/10 min) or less. In this case, since the UFP scattered amount generated from the imaging system 1 can be suppressed to $3.5\times10^{11}$ (number of particles/10 min) or less, the quality standard for the UFP scattered amount may be satisfied.

The ionizer 71 includes the first electrode 75 to which a voltage is applied in an ON state, and the second electrodes 76. When the voltage applied to the first electrode 75 is a predetermined value or more, a current flows between the first electrode 75 and the second electrodes 76 due to a discharge phenomenon and the ionizer 71 may charge the UFP 5 passing between the first electrode 75 and the second electrodes 76 by the current. The first electrode 75 may include the plurality of protrusions 75*a* used for a discharging process. In this case, the UFP 5 can be charged and trapped in such a manner that the UFP 5 passes between the first electrode 75 and the second electrodes 76.

The control unit 74 controls the voltage applied to the first electrode 75, and the control unit 74 may control the magnitude of the voltage applied to the first electrode 75 so that the amount of the current flowing between the first electrode 75 and the second electrodes 76 becomes a predetermined target value. In this case, since constant current control can be performed, the voltage can be adjusted so that the current amount is stabilized to a target value.

The collection device (or trapping device) 70 includes the ionizer 71, the particle filter 72 which collects the UFP 5 charged by the ionizer 71, and the exhaust fan 73 which generates the air flow 7 for transferring the UFP 5 and the exhaust fan 73 may be disposed on the side opposite to the ionizer 71 when viewed from the particle filter 72. In this case, the exhaust fan 73 can generate the air flow 7 so that the UFP 5 charged by the ionizer 71 is transferred to the particle filter 72.

Figure 13:
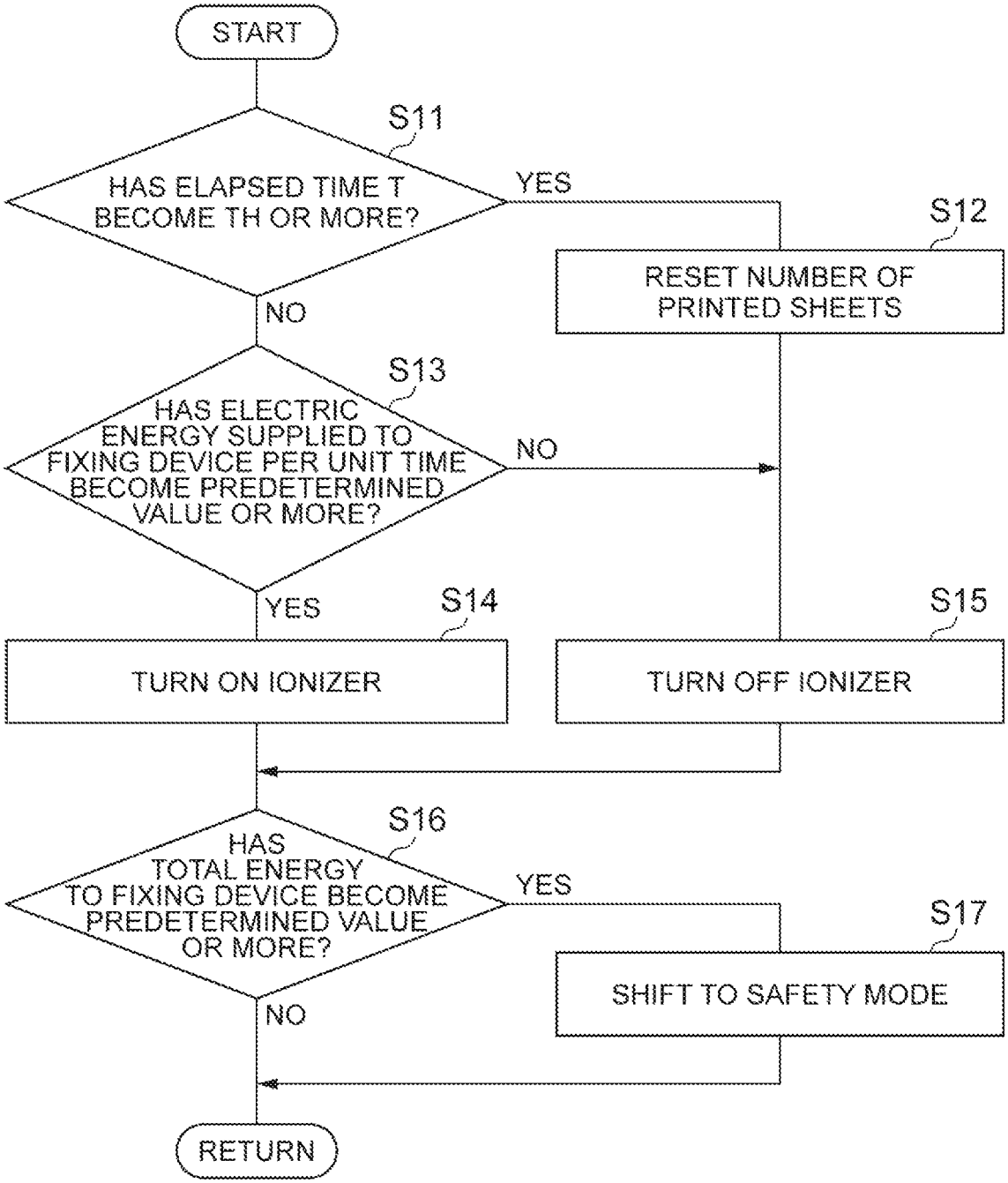
FIG. 13 is a flowchart illustrating an example of ON/OFF control of an ionizer and operation control of a fixing device.

A modified example of the control of the ionizer 71 of the control unit 74 and the control of the fixing device 50 will be described with reference to the flowchart of FIG. 13. Since the example of FIG. 13 has the same contents as those of the example of FIG. 11, redundant description of similar features as those of the example of FIG. 11 may be omitted. When a certain printing job ends and the next printing job starts, the control unit 74 determines whether the elapsed time T from the final printing operation is the predetermined time TH or more (operation S11).

When the control unit 74 determines that the elapsed time T from the final printing operation is the predetermined time TH or more (YES in operation S11), the number of printed sheets is reset (operation S12). Meanwhile, when the control unit 74 determines that the elapsed time T is not the predetermined time TH or more (NO in operation S11), it is determined whether the electric energy supplied to the fixing device 50 per unit time is a predetermined value or more (operation S13). At this time, the control unit 74 may perform the above-described determination by acquiring the electric energy amount to the fixing device 50 per unit time measured by the energy measurement unit 55.

When the control unit 74 determines that the electric energy to the fixing device 50 per unit time is a predetermined value or more (YES in operation S13), it is determined that the UFP scattered amount increases and the ionizer 71 is turned on (operation S14). When the control unit 74 determines that the electric energy to the fixing device 50 per unit time is not the predetermined value or more (NO in operation S13), it is determined that the UFP scattered amount is low and the ionizer 71 is turned off (operation S15).

After operation S14 or operation S15, for example, it is determined whether the electric energy to the fixing device 50 is a predetermined value or more (operation S16). When it is determined that the electric energy to the fixing device 50 is the predetermined value or more, the imaging system 1 shifts to the safety mode as the UFP scattered amount increases (operation S17). Furthermore, the contents of operation S16 and operation S17 may be the same as those of operation S6 and operation S7 of FIG. 11.

As described above, as in the example of FIG. 13, the control unit 74 may turn on the ionizer 71 when the electric energy supplied to the fixing device 50 per unit time becomes a predetermined value or more. In this case, when the electric energy supplied to the fixing device 50 per unit time is large and the UFP scattered amount is large, the ionizer 71 is turned on to decrease the UFP scattered amount.

The control unit 74 may turn off the ionizer 71 when the electric energy supplied to the fixing device 50 per unit time is not a predetermined value or more. In this case, the ionizer 71 can be turned off when the electric energy supplied to the fixing device 50 per unit time is low and the UFP scattered amount is low. Thus, since the unnecessary operation of the ionizer 71 can be suppressed, the power consumption can be suppressed and the life of the ionizer 71 can be increased or extended.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

For example, in the description above, an example in which the collection device 70 traps UFP has been described. However, the collection device 70 may trap or collect particles other than UFP. The collection device 70 may trap or collect particles generated from a part other than the fixing device 50. Accordingly, the collection device 70 may be suitably adapted to collect particles of a different type.

In addition, an example has been described in which the control unit 74 determines the elapsed time T between the first printing job J1 and the second printing job J2, compares the elapsed time T with the predetermined time TH, and resets the number of printed sheets when the elapsed time T is the predetermined time TH or more. However, the trigger for the control unit to reset the number of printed sheets may be other than the elapsed time T. In other examples, the control unit may not reset the number of printed sheets.

Further, an example in which the ionizer 71 is turned on when the number of printed sheets reaches a predetermined number of sheets or more, has been described. However, the trigger for turning on and off the ionizer 71 may be other than the number of printed sheets and may be the temperature of the fixing device 50 as described above. In this case, for example, the ionizer 71 is turned on when the temperature of the fixing device 50 becomes equal to or higher than a predetermined temperature and the ionizer 71 is turned off when the temperature of the fixing device 50 becomes lower than the predetermined temperature.

Further, in the above-described example, the collection device 70 including the ionizer 71, the particle filter 72, the exhaust fan 73, and the control unit 74 has been described, but the configurations of the ionizer, the particle filter, the exhaust fan, and the control unit of the collection device can be appropriately changed.

The invention claimed is:

1. An imaging system comprising:

a fixing device;

a collection device to collect ultrafine particles (UFP) emitted by the fixing device, the collection device including an ionizer; and a controller to count a number of printed media, and to turn on the ionizer when the number of printed media is equal to or greater than a predetermined number of media.

2. The imaging system according to claim 1, the controller to determine whether an elapsed time which is a time elapsed from a final printing operation, is equal to or greater than a predetermined time, and to turn off the ionizer and reset the number of printed media in response to determining that the elapsed time is equal to or greater than the predetermined time.

3. The imaging system according to claim 2, the controller to turn on the ionizer when a printing operation starts and the number of printed media is equal to or greater than the predetermined number of media, to turn off the ionizer when the printing operation starts and the number of printed media is equal to or less than the predetermined number of media, and to reset the number of printed media in response to determining that the elapsed time is the predetermined time or more.

4. The imaging system according to claim 2, the controller to compare the number of printed media with the predetermined number of media when the elapsed time is less than the predetermined time, and to turn on the ionizer when the number of printed media is equal to or more than the predetermined number of media.

5. The imaging system according to claim 2, further comprising:

a temperature measurement device to measure a temperature of the fixing device, the controller to turn on the ionizer when the temperature of the fixing device measured by the temperature measurement device is equal to or more than a predetermined temperature, and to turn off the ionizer when the temperature of the fixing device measured by the temperature measurement device is less than the predetermined temperature.

6. The imaging system according to claim 1, further comprising:

an energy measurement device to measure electric energy supplied to the fixing device, the controller to perform at least one of an operation of pausing a printing operation in execution, and an operation of decreasing a printing speed, when the electric energy to the fixing device measured by the energy measurement device is equal to or more than a predetermined value.

7. The imaging system according to claim 6, wherein the energy measurement device determines an average power consumed by the fixing device for a predetermined time.

8. The imaging system according to claim 1, further comprising:

an energy measurement device to measure electric energy supplied to the fixing device, the controller to turn on the ionizer when the electric energy supplied to the fixing device per time unit is equal to or greater than a predetermined value, and to turn off the ionizer when the electric energy supplied to the fixing device per time unit is less than the predetermined value.

9. The imaging system according to claim 1, further comprising:

a temperature measurement device to measure a temperature of the fixing device, the controller to perform at least one of an operation of pausing a printing operation in execution, and an operation of decreasing a printing speed, when the temperature of the fixing device measured by the temperature measurement device is equal to or more than a predetermined temperature.

10. The imaging system according to claim 1, the controller to select an ON/OFF state of the ionizer so that a particle emission rate of the UFP is equal to or less than $3.5\times10^{11}$ (number of particles/10 min).

11. The imaging system according to claim 1, wherein the ionizer includes a first electrode to receive a voltage in an ON state, and a second electrode, wherein when the voltage applied to the first electrode is equal to or greater than a predetermined voltage, a current flows between the first electrode and the second electrode due to a discharge phenomenon, and wherein the ionizer charges the UFP passing between the first electrode and the second electrode by the current.

12. The imaging system according to claim 11, wherein the first electrode includes a plurality of protrusions to be used in a discharging process.

13. The imaging system according to claim 11, the controller to control a voltage applied to the first electrode, and the controller to control a magnitude of the voltage applied to the first electrode to adjust a current flowing between the first electrode and the second electrode to a target current.

14. The imaging system according to claim 11, wherein the collection device includes a particle filter to collect the UFP charged by the ionizer, and an exhaust fan to generate an air flow to transfer the UFP, and wherein the particle filter is located between the exhaust fan and the ionizer.

15. An imaging system comprising:

a fixing device;

a collection device to collect ultrafine particles (UFP) emitted by the fixing device, the collection device including an ionizer;

a temperature measurement device to measure a temperature of the fixing device; and a controller to turn on the ionizer when the temperature of the fixing device measured is equal to or greater than a predetermined temperature, and to turn off the ionizer when the temperature of the fixing device measured is lower than a threshold temperature.

* * * * *